US010597200B2

(12) United States Patent
Asakawa et al.

(10) Patent No.: US 10,597,200 B2
(45) Date of Patent: Mar. 24, 2020

(54) SCREW CAP CONTAINER

(71) Applicants: Noriyuki Asakawa, Tokyo (JP); Tatsuharu Ida, Tokyo (JP); Takumi Sugizaki, Tokyo (JP); Shigeru Hayakawa, Tokyo (JP)

(72) Inventors: Noriyuki Asakawa, Tokyo (JP); Tatsuharu Ida, Tokyo (JP); Takumi Sugizaki, Tokyo (JP); Shigeru Hayakawa, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 110 days.

(21) Appl. No.: 15/552,780

(22) PCT Filed: Feb. 3, 2016

(86) PCT No.: PCT/JP2016/000567
§ 371 (c)(1),
(2) Date: Aug. 22, 2017

(87) PCT Pub. No.: WO2016/136150
PCT Pub. Date: Sep. 1, 2016

(65) Prior Publication Data

US 2018/0044072 A1 Feb. 15, 2018

(30) Foreign Application Priority Data

Feb. 27, 2015 (JP) ..... 2015-039335
Mar. 30, 2015 (JP) ..... 2015-070050

(51) Int. Cl.
*B65D 41/04* (2006.01)
*B65D 1/02* (2006.01)

(52) U.S. Cl.
CPC ..... *B65D 41/0471* (2013.01); *B65D 1/0246* (2013.01); *B65D 41/04* (2013.01);
(Continued)

(58) Field of Classification Search
CPC ..... B65D 41/0471; B65D 41/0421; B65D 41/0414; B65D 41/0428; B65D 41/04; B65D 1/0246
(Continued)

(56) References Cited

U.S. PATENT DOCUMENTS 2,257,715 A 9/1941 Hopkins
3,127,049 A * 3/1964 Welty et al. ..... F16J 13/12 220/301
(Continued)

FOREIGN PATENT DOCUMENTS

CN 1209784 A 3/1999
JP S53-144445 U 11/1978
(Continued)

OTHER PUBLICATIONS

Sep. 26, 2018 Extended Search Report issued in European Patent Application No. 16754906.2.
(Continued)

*Primary Examiner* — Ernesto A Grano
(74) *Attorney, Agent, or Firm* — Oliff PLC

(57) ABSTRACT

A screw cap container including a container main body and a screw cap. The container main body includes a mouth tubular portion, which is provided with slope screw portions. The slope screw portions include: upper screw protrusions disposed at three or more different positions; lower long screw protrusions having left end positions same as left end positions of the upper screw protrusions, and each having a length longer than a length of each upper screw protrusion; and oblique screw protrusions extending obliquely from right ends of the lower long screw protrusions and each being connected to a left end of a different one of the upper screw protrusions. The screw cap includes a top wall and an outer circumferential wall. The outer circumferential wall is
(Continued)

provided with cap screw protrusions disposed in the same number as the number of the upper screw protrusions.

7 Claims, 16 Drawing Sheets

(52) U.S. Cl.
CPC ..... *B65D 41/0414* (2013.01); *B65D 41/0421* (2013.01); *B65D 41/0428* (2013.01)

(58) Field of Classification Search
USPC ..... 220/288
See application file for complete search history.

(56) References Cited

U.S. PATENT DOCUMENTS 3,741,421 A * 6/1973 Wittwer ..... B65D 41/0471 215/216
4,139,112 A * 2/1979 Cooke ..... B65D 50/043 215/217
4,373,641 A * 2/1983 Banich, Sr. ..... B65D 41/04 215/331
4,591,063 A * 5/1986 Geiger ..... B65D 41/0478 215/330
5,449,077 A * 9/1995 Seidler ..... B65D 50/045 215/206
5,687,863 A * 11/1997 Kusz ..... B65D 41/0471 215/216
5,887,739 A * 3/1999 Prevot ..... B65D 1/023 215/382
6,006,930 A 12/1999 Dreyer et al.
D423,936 S * 5/2000 Smith ..... D9/520
D428,815 S * 8/2000 Mooney ..... D9/520
D442,866 S * 5/2001 Mooney ..... D9/520
6,227,391 B1 * 5/2001 King ..... B65D 41/0471 215/307
D467,813 S * 12/2002 Silvers ..... D9/538
6,568,156 B2 * 5/2003 Silvers ..... B65B 3/022 53/140
D612,250 S * 3/2010 Shah ..... D9/538
8,371,463 B2 * 2/2013 Beecroft ..... B65D 50/046 215/216
9,073,672 B2 * 7/2015 Laperriere ..... B65D 41/02
2004/0173565 A1 * 9/2004 Semersky ..... B65D 1/0223 215/382
2007/0062952 A1 3/2007 Kobayashi et al.
2008/0110850 A1 * 5/2008 Tilton ..... B65D 41/0471 215/330
2008/0302799 A1 * 12/2008 Moore ..... B65D 7/04 220/288
2009/0301986 A1 * 12/2009 Phelan ..... B65D 41/0421 215/252
2011/0024382 A1 * 2/2011 Moreira ..... B65D 1/0246 215/316
2012/0000879 A1 * 1/2012 McFarlane ..... B65D 1/0246 215/44
2012/0037589 A1 * 2/2012 King ..... B65D 41/0421 215/329
2012/0255953 A1 * 10/2012 House ..... B65D 50/061 220/288
2014/0263339 A1 * 9/2014 Bates ..... B65D 41/0464 220/296
2014/0319144 A1 * 10/2014 Tsuzuki ..... B65D 41/3447 220/304
2015/0329232 A1 * 11/2015 Brozell ..... C03B 9/325 215/44
2017/0166360 A1 * 6/2017 Falzoni ..... B65D 41/0421

FOREIGN PATENT DOCUMENTS

JP S57-151237 U 9/1982
JP S63-258764 A 10/1988
JP H09-272554 A 10/1997
JP 2000-503944 A 4/2000
JP 2001-219951 A 8/2001
JP 2001-247141 A 9/2001
JP 2005-053577 A 3/2005
JP 2005-104499 A 4/2005
JP 2011-136745 A 7/2011
WO 82/03058 A1 9/1982
WO 97/37901 A1 10/1997
WO 98/46493 A1 10/1998

OTHER PUBLICATIONS

Dec. 24, 2018 Office Action issued in Chinese Patent Application No. 201680011638.2.
Apr. 12, 2016 International Search Report issued in International Patent Application No. PCT/JP2016/000567.
Aug. 29, 2017 International Preliminary Report on Patentability issued in International Patent Application No. PCT/JP2016/000567.
May 28, 2018 Office Action issued in Chinese Patent Application No. 201680011638.2.
May 17, 2019 Office Action issued in Chinese Patent Application No. 201680011638.2.
Sep. 18, 2018 Office Action issued in Japanese Patent Application No. 2015-070050.

* cited by examiner

FIG. 14A
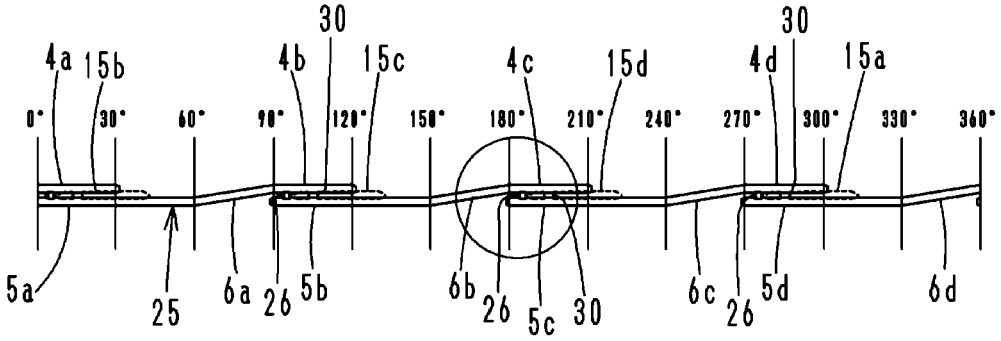
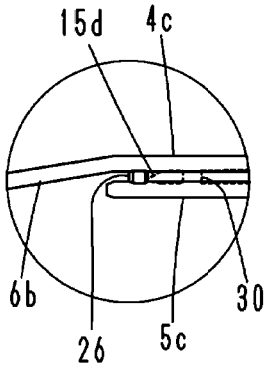
FIG. 14B
FIG. 14C
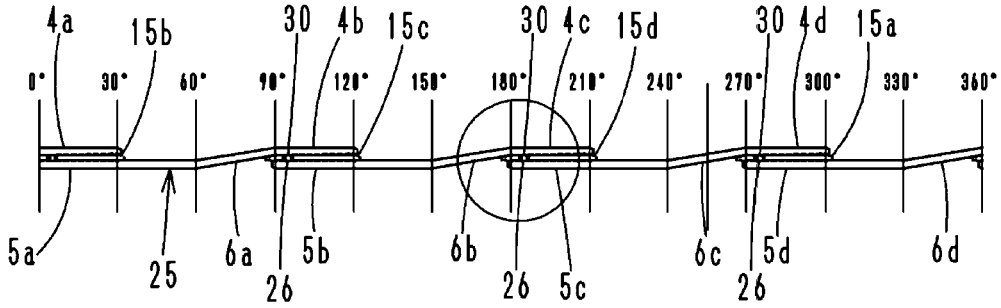
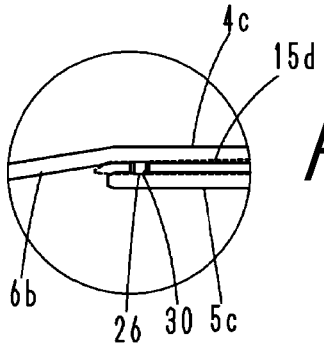
FIG. 14D

SCREW CAP CONTAINER

TECHNICAL FIELD

The present disclosure relates to a container provided with a screw cap configured to be screwed with a mouth tubular portion of a container main body. Especially, the present disclosure relates to a screw cap container that may be capped reliably, that may be uncapped with a little rotation at the time of uncapping, and that provides a click sensation at the time of uncapping and capping.

BACKGROUND

An existing widely-used screw cap container may be capped by screw-fastening a female screw portion provided in a cap with a male screw portion provided in a mouth tubular portion of a container main body.

Concrete examples of such an existing screw cap container may include the one including the container main body, which has a container mouth provided on an outer circumferential surface thereof with screw threads formed as a plurality of ridges, and the cap, which is provided on an inner circumference thereof with engagement portions configured to engage with the screw threads. The existing screw cap container permits opening and closing operations with a rotational angle that is smaller than a full rotational angle and, once being capped, is not easily disengaged (refer, for example, to Patent Literature 1).

CITATION LIST

Patent Literature

PTL 1: JP2011136745A

SUMMARY

Technical Problems

However, the aforementioned screw cap container described in Patent Literature 1 poses the problem that the cap, when being placed on the container main body at the time of capping, might give rise to oblique capping.

Furthermore, when the container has a wide mouth, the diameter of the mouth is increased compared with the height of the cap. This raises the probability of oblique capping. In the event of oblique capping, the cap needs to be pressed forcedly into a horizontal position. In some cases, oblique capping might not be solved due to insufficient force, leading to the problem of closure failure.

The present disclosure is to solve the above problems, and the present disclosure is to provide a screw cap container that prevents oblique capping by maintaining the screw cap horizontally with respect to the container main body before the beginning of screwing at the time of capping.

The present disclosure is also to provide a screw cap container that provides a click sensation to a user at the time of uncapping and capping and that provides more or less resistance during uncapping.

Solution to Problems

One of aspects of the present disclosure for solving the above problems adopts a screw cap container including a container main body and a screw cap. The container main body includes a mouth tubular portion, which is provided on an outer circumference thereof with slope screw portions configured to be screwed to the screw cap. The slope screw portions include: upper screw protrusions disposed at three or more different positions at an equal interval in a top view thereof; lower long screw protrusions having left end positions same as left end positions of the upper screw protrusions, being disposed a predetermined height below and in parallel with the upper screw protrusions, and each having a length longer than a length of each upper screw protrusion; and oblique screw protrusions extending obliquely in an upper right direction from right ends of the lower long screw protrusions and each being connected to a left end of a different one of the upper screw protrusions. The screw cap includes a top wall and an outer circumferential wall suspended from an outer edge of the top wall. The outer circumferential wall is provided on an inner circumference thereof with cap screw protrusions disposed at an equal interval and at an equal height in the same number as the number of the upper screw protrusions and thus configured to be screwed with the slope screw portions of the container main body.

In one applicable embodiment of the screw cap container, the slope screw portions include: the upper screw protrusions disposed at four or more even number of positions; and partial gaps in which no oblique screw protrusions and no lower long screw protrusions are present, the gaps being defined between one of the upper screw protrusions and another one of the upper screw protrusions located adjacent thereto at two different positions at an interval of 180° in the top view thereof. In another applicable embodiment of the screw cap container, the cap screw protrusions are disposed at positions above a middle of a vertical height of the inner circumference of the outer circumferential wall, thereby permitting the screw cap to be placed deeply.

In one concrete embodiment of the screw cap container, the screw cap includes a sealing tubular portion suspended from a back surface of the top wall, and the sealing tubular portion is provided on an inner side of a lower end thereof with an inner ring in a suspended manner, the inner ring being configured to be inserted in an inner circumference of the mouth tubular portion of the container main body and seal an inside of the container main body at the time of capping. In another concrete embodiment of the screw cap container, the sealing tubular portion is further provided on an outer side of the lower end thereof with a contact ring in a suspended manner, the contact ring being deformable and having a tip portion configured to tightly contact an upper surface of the mouth tubular portion of the container main body at the time of capping.

In yet another concrete embodiment of the screw cap container, the slope screw portions further include engagement protrusions disposed between the upper screw protrusions and the lower long screw protrusions, and the cap screw protrusions of the screw cap are provided with engagement recesses. In yet another concrete embodiment of the screw cap container, the mouth tubular portion of the container main body is further provided on the outer circumference thereof with a neck ring, the neck ring is provided on an outer circumference thereof with an outward engagement ridge, and the outer circumferential wall of the screw cap is further provided on the inner circumference thereof with an inward engagement ridge.

Advantageous Effects

In the screw cap container according to the present disclosure, the container main body includes the mouth tubular portion, which is provided on the outer circumference thereof with the slope screw portions configured to be screwed to the screw cap. The slope screw portions include: the upper screw protrusions disposed at three or more different positions at an equal interval in the top view thereof; the lower long screw protrusions having the left end positions same as the left end positions of the upper screw protrusions, being disposed a predetermined height below and in parallel with the upper screw protrusions, and each having the length longer than the length of each upper screw protrusion; and oblique screw protrusions extending obliquely in the upper right direction from the right ends of the lower long screw protrusions and each being connected to the left end of a different one of the upper screw protrusions. The screw cap includes the outer circumferential wall, which is provided on the inner circumference thereof with the cap screw protrusions disposed at an equal interval and at an equal height in the same number as the number of the upper screw protrusions and thus configured to be screwed with the slope screw portions of the container main body. Accordingly, when the screw cap is placed on the mouth tubular portion of the container main body at the time of capping, the cap screw protrusions provided in the screw cap abut against the upper screw protrusions or the oblique screw protrusions of the slope screw portions, thereby maintaining the screw cap horizontally with respect to the container main body. This permits capping in which screwing is proceeded with reliably while preventing oblique capping.

Furthermore, at the time of uncapping, the screw cap may be unscrewed with a little rotational angle and thus disengaged easily and quickly.

Moreover, the screw cap container provides a click sensation to a user at the time of uncapping and capping and prevents spontaneous uncapping caused by an external impact outside the container while the container is capped.

BRIEF DESCRIPTION OF THE DRAWINGS

In the accompanying drawings:

FIG. 1A is a sectional top view taken along an X-X line in FIG. 1B, and FIG. 1B is a partially perspective side view;

FIG. 2A is a top view, and FIG. 2B is a side view;

FIG. 3A is a sectional top view taken along an X-X line of FIG. 3B, FIG. 3B is a sectional side view, and FIG. 3C is a partially enlarged view of FIG. 3B;

FIG. 6A is a sectional side view, and FIG. 6B is a partially enlarged view of FIG. 6A;

FIG. 7A is a top view, and FIG. 7B is a side view;

FIG. 9A is a partial sectional side view, and FIG. 9B is a partially enlarged view of FIG. 9A;

FIG. 10A is a partial sectional side view, and FIG. 10B is a partially enlarged view of FIG. 10A;

FIG. 11A is a partial sectional side view, and FIG. 11B is a partially enlarged view of FIG. 11A;

FIG. 12A is a top view, and FIG. 12B is a side view;

FIG. 13A is a sectional top view taken along an X-X line of FIG. 13B, and FIG. 13B is a sectional side view;

FIGS. 14A to 14D are interaction views of slope screw portions of a container main body and cap screw protrusions of a screw cap according to Embodiment 4 of the present disclosure, and FIG. 14A corresponds to time just before capping, FIG. 14B corresponds to a partially enlarged view of FIG. 14A, FIG. 14C corresponds to the time of the end of capping, and FIG. 4D is a partially enlarged view of FIG. 14C;

FIG. 16A is a sectional side view, and FIG. 16B is a partially enlarged view of FIG. 16A.

DETAILED DESCRIPTION

The following describes a screw cap container of the present disclosure with reference to the drawings of preferred embodiments.

Embodiment 1

In the description below, in a top view as illustrated in FIGS. 1A, 2A, 3A, and 7A, the left side is defined as 0° (a starting point), and sections a, b, c, and d are defined anticlockwise at an interval of 90° for convenience.

Figure 1A:
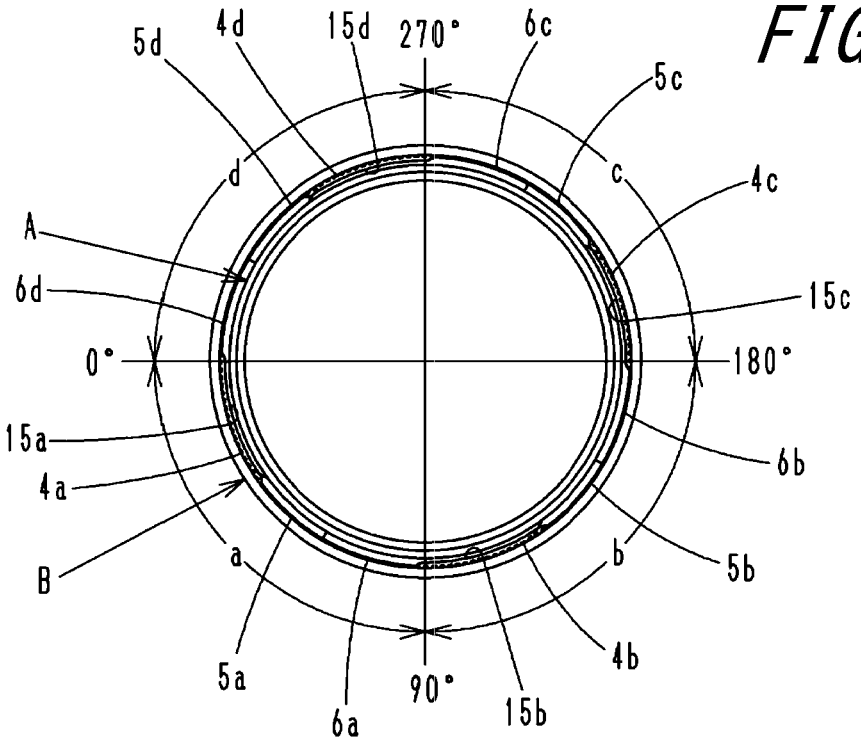
FIGS. 1A and 1B illustrate a screw cap and a container main body according Embodiment 1 of the present disclosure.
Figure 1B:
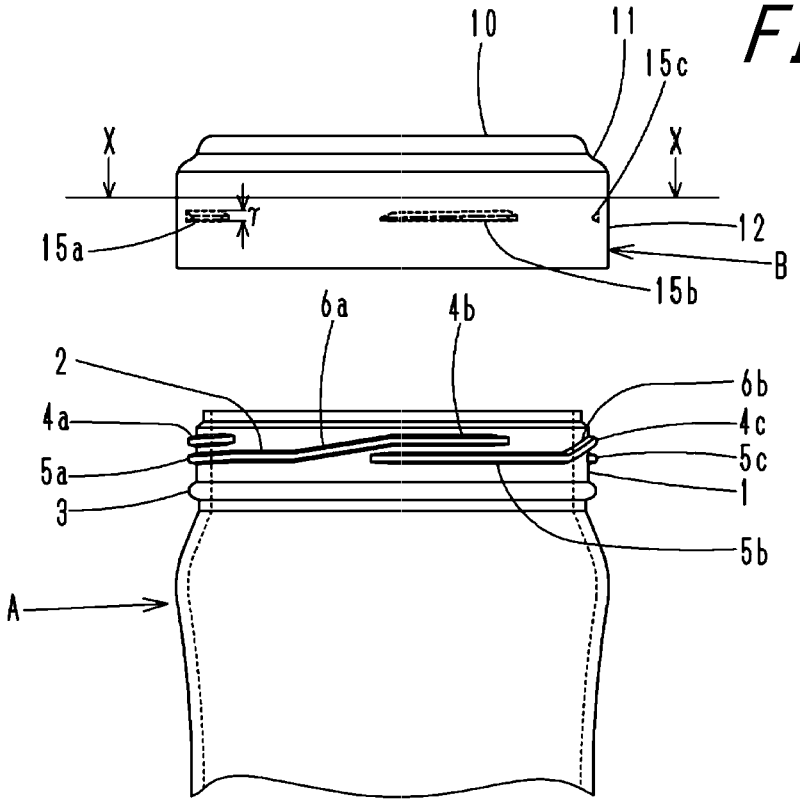

In FIGS. 1A and 1B, reference numeral A denotes a container main body, and reference numeral B denotes a screw cap.

Figure 2A:
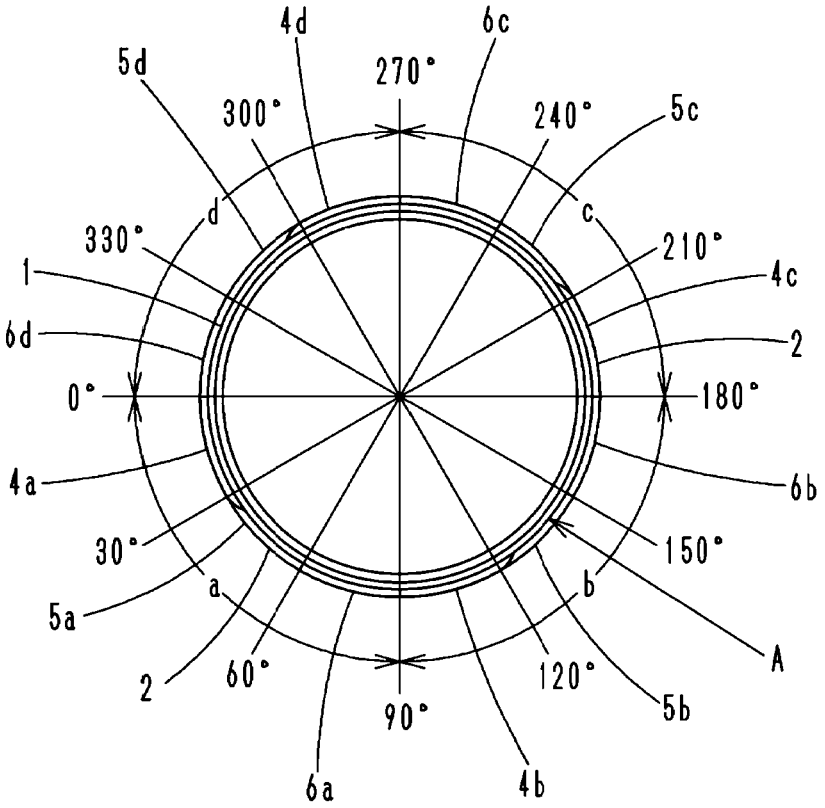
FIGS. 2A and 2B illustrate a container main body according to Embodiment 1 of the present disclosure.
Figure 2B:
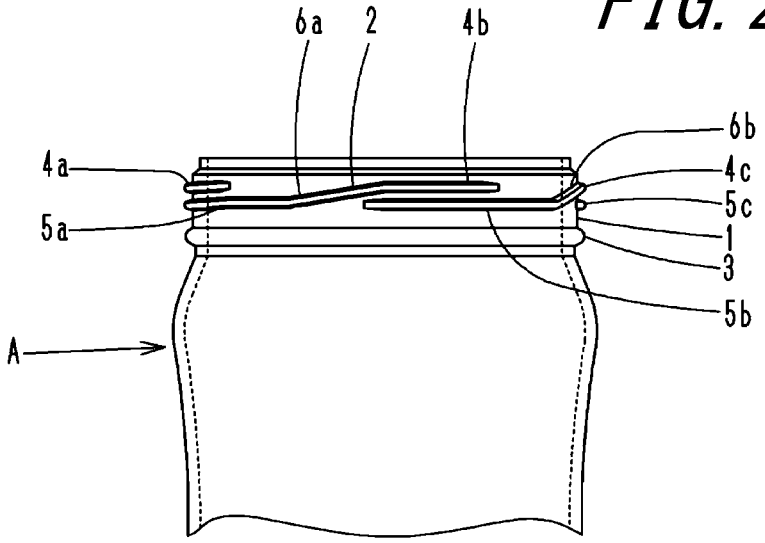

As illustrated in FIGS. 2A and 2B, the container main body A includes a mouth tubular portion 1. The mouth tubular portion 1 is provided on an outer circumference thereof with slope screw portions 2, which protrude as four ridges configured to be screwed to the screw cap B. The mouth tubular portion 1 is also provided on the outer circumference thereof with a neck ring 3, which protrudes below the slope screw portions 2.

As illustrated in FIGS. 4A to 4D, the slope screw portions 2 are configured by upper screw protrusions 4*a*, 4*b*, 4*c*, and 4*d*, lower long screw protrusions 5*a*, 5*b*, 5*c*, and 5*d*, and oblique screw protrusions 6*a*, 6*b*, 6*c*, and 6*d*. In the top view, the upper screw protrusions 4*a*, 4*b*, 4*c*, and 4*d* are disposed at four different positions at an (equal) interval of 90°. In the front view, the upper screw protrusions 4*a*, 4*b*, 4*c*, and 4*d* extend horizontally or gently obliquely in the lower left direction and each have a length (angular range) in the circumferential direction of approximately 30°. The lower long screw protrusions 5*a*, 5*b*, 5*c*, and 5*d* are disposed a predetermined interval (height) (which is set as a width γ of cap screw protrusions 15*a* to 15*d*, which are described later) below and in parallel with the upper screw protrusions 4*a*, 4*b*, 4*c*, and 4*d*, have left end positions same as left end positions of the upper screw protrusions 4*a*, 4*b*, 4*c*, and 4*d*, and each have a length in the circumferential direction of approximately 60° (which is longer than the length in the circumferential direction of the upper screw protrusions 4*a*, 4*b*, 4*c*, and 4*d*). The oblique screw protrusions 6*a*, 6*b*, 6*c*, and 6*d* extend obliquely in the upper right direction from right ends of the lower long screw protrusions 5*a*, 5*b*, 5*c*, and 5*d* and each are connected to a left end of a different one of the upper screw protrusions 4*a*, 4*b*, 4*c*, and 4*d*.

Figure 4A:
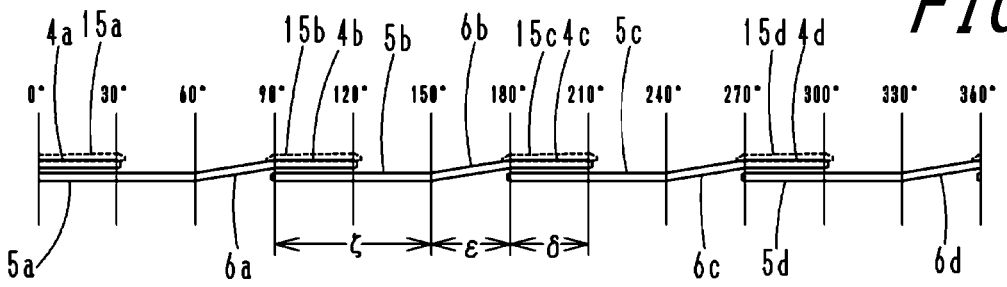
FIGS. 4A to 4D are interaction views of slope screw portions of a container main body and cap screw protrusions of a screw cap according to Embodiment 1 of the present disclosure, and FIG. 4A corresponds to the time of the beginning of capping, FIG. 4B corresponds to the initial time of rotation, FIG. 4C corresponds to the middle time of rotation, and FIG. 4D corresponds to the time of the end of capping.

As illustrated in FIG. 4A, each upper screw protrusion, each oblique screw protrusion, and each lower long screw protrusion, which constitute the slope screw portions 2, respectively have a length δ in the circumferential direction, a length ε in the circumferential direction, and a length ζ in the circumferential direction, where a ratio of δ, ε, and ζ is 1:1:2.

Figure 3A:
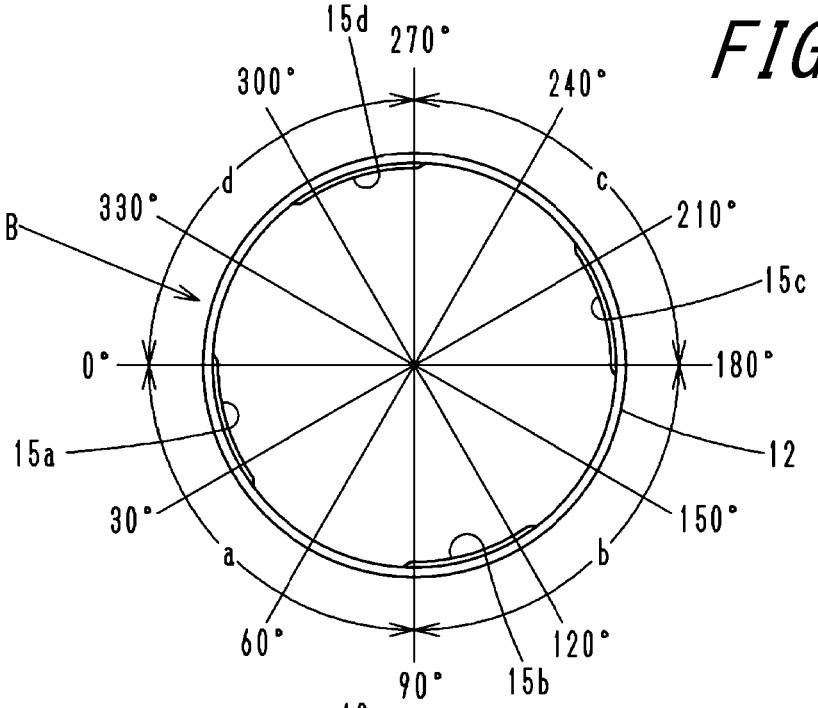
FIGS. 3A to 3C illustrate a screw cap according to Embodiment 1 of the present disclosure.
Figure 3B:
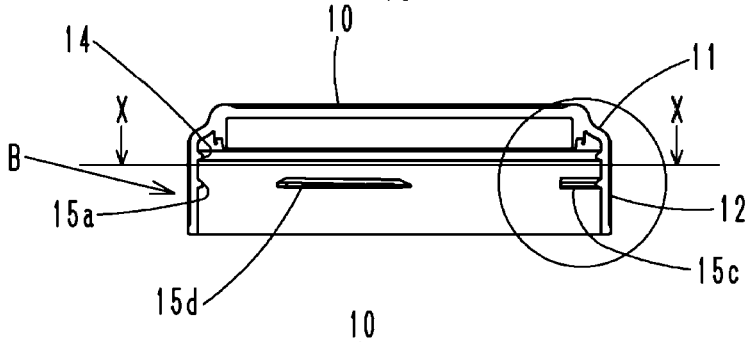
Figure 3C:
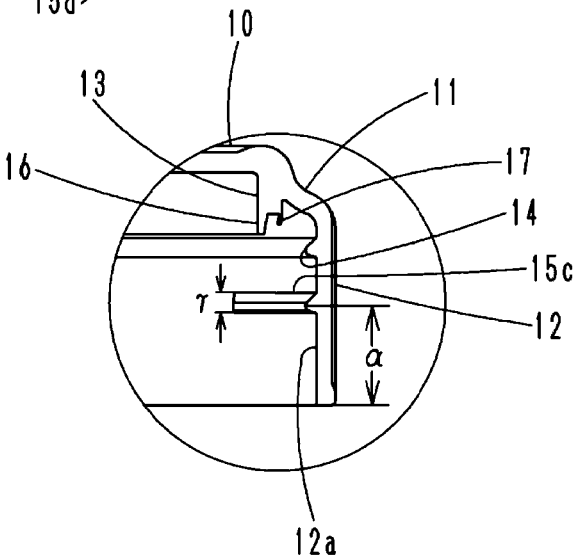

As illustrated in FIGS. 1B, 3B, and 3C, the screw cap B includes a disc-shaped top wall 10, an inclined wall 11, which is connected to an outer edge of the top wall 10 and which is inclined outward and downward, a cylindrical-shaped outer circumferential wall 12, which is suspended from an outer edge of the inclined wall 11, and a sealing tubular portion 13, which is suspended from an outer edge of a back surface of the top wall 10.

In the present embodiment, the inclined wall 11 is disposed between the top wall 10 and the outer circumferential wall 12. However, the inclined wall 11 may be omitted, and the outer circumferential wall 12 may be provided in a suspended manner directly from the outer edge of the top wall 10.

The outer circumferential wall 12 is provided, in an upper portion of an inner circumference thereof, with an annular protrusion 14. The outer circumferential wall 12 is also provided, in portions thereof that are located below the annular protrusion 14, with the cap screw protrusions 15*a*, 15*b*, 15*c*, and 15*d*, which each have a length in the circumferential direction of 30° to 40° (preferably approximately 34°). The cap screw protrusions 15*a*, 15*b*, 15*c*, and 15*d* are disposed at an (equal) interval of 90° in the circumferential direction at four different positions that are located at a height α from a lower end of the outer circumferential wall 12.

In the present embodiment, the cap screw protrusions 15*a* etc. are disposed at the four positions. However, it is to be noted that the cap screw protrusions 15*a* etc. need to be disposed in the same number as the number of the disposed upper screw protrusions 4*a* etc.

Additionally, a portion of the inner circumference of the outer circumferential wall 12 that is located below the cap screw protrusions 15*a*, 15*b*, 15*c*, and 15*d* forms an engagement surface 12*a*, which is configured to come into sliding contact with outer surfaces of the slope screw portions 2.

The cap screw protrusions 15*a*, 15*b*, 15*c*, and 15*d* has a width γ, which is defined to be the interval (height) between the upper screw protrusions 4*a*, 4*b*, 4*c*, and 4*d* and the lower long screw protrusions 5*a*, 5*b*, 5*c*, and 5*d* of the slope screw portions 2 of the container main body A so that the cap screw protrusions 15*a*, 15*b*, 15*c*, and 15*d* are engaged therebetween.

The cap screw protrusions 15*a*, 15*b*, 15*c*, and 15*d* have lower surfaces that extend horizontally or obliquely downward gently toward a rotational direction at the time of capping in a manner such that the lower surfaces are parallel with upper surfaces of the upper screw protrusions 4*a*, 4*b*, 4*c*, and 4*d*. The cap screw protrusions 15*a*, 15*b*, 15*c*, and 15*d* each also have an upper surface that extends obliquely further downward (with a tapering width) toward the rotational direction at the time of capping with respect to the corresponding lower surface.

As illustrated in FIG. 3C, the sealing tubular portion 13 is provided, on the inner side of a lower end thereof, with an inner ring 16 in a suspended manner, and is also provided, on the outer side of the lower end thereof, with a contact ring 17 in a suspended manner. The inner ring 16 is configured to be inserted in an inner circumference of the mouth tubular portion 1 of the container main body A and has an outer circumference that seals the inside of the container main body A at the time of capping. The contact ring 17 is formed as a deformable and thin ring having a tip portion configured to tightly contact an upper surface of the mouth tubular portion 1 of the container main body A at the time of capping.

In the present embodiment, the cap B includes the sealing tubular portion 13 to seal the inside of the container main body A. However, the sealing tubular portion 13 may be omitted when a sealing member, such as a packing, is provided in the mouth tubular portion 1 of the container main body A.

Next, a description is given of modes of use and advantageous effects of the present embodiment.

In the container used in the present embodiment, the mouth tubular portion 1 has a relatively large diameter of 76 mm.

When the screw cap B is placed from above on the mouth tubular portion 1 of the container main body A, the screw cap B is displaced downward, with the engagement surface 12*a* on the inner circumference of the outer circumferential wall 12 being in sliding contact with the outer circumferences of the slope screw portions 2 of the container main body A.

Suppose, for example, that the screw cap B is placed, with the cap screw protrusion 15*a* being located at a position corresponding to an angle between 0° and 30° in the section a with respected to the container main body A. In this case, as illustrated in FIG. 4A, the lower surfaces of the cap screw protrusions 15*a*, 15*b*, 15*c*, and 15*d* abut against the upper surfaces of the upper screw protrusions 4*a*, 4*b*, 4*c*, and 4*d*, which constitute the slope screw portions 2 of the container main body A.

Consequently, the cap screw protrusions 15*a*, 15*b*, 15*c*, and 15*d* evenly abut against the upper screw protrusions 4*a*, 4*b*, 4*c*, and 4*d*, disposed at an interval of 90°, of the slope screw portions 2. This permits the screw cap B to be always placed horizontally with respect to the mouth tubular portion 1 of the container main body A. Accordingly, the screw cap B is prevented from being placed obliquely with respect to the mouth tubular portion 1, and capping is proceeded with reliably.

In the present embodiment, the slope screw portions 2 are disposed protrudingly in the form of the four ridges at an equal interval. However, to maintain the cap B horizontally with respect to the container main body A at the time of the beginning of capping, the slope screw portions 2 only need to be disposed protrudingly in the form of three or more ridges at an equal interval.

Figure 4B:
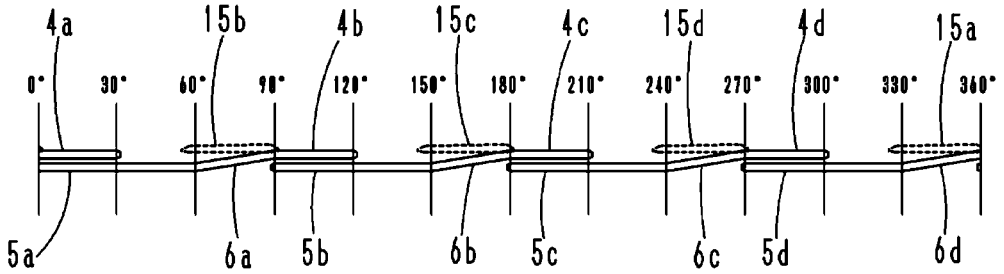

Subsequently, suppose that the screw cap B is rotated clockwise through 30° or more from the position in which the screw cap B is placed on the container main body A. Then, the cap screw protrusions 15*a*, 15*b*, 15*c*, and 15*d* are displaced off from the upper surfaces of the upper screw protrusions 4*a*, 4*b*, 4*c*, and 4*d*. As illustrated in FIG. 4B, right ends of the lower surfaces of the cap screw protrusions 15*a*, 15*b*, 15*c*, and 15*d* abut against oblique upper surfaces of the oblique screw protrusions 6*d*, 6*a*, 6*b*, and 6*c* of the slope screw portions 2. As the rotation further proceeds, the screw cap B is displaced downward in accordance with obliquity of the oblique screw protrusions 6*d*, 6*a*, 6*b*, and 6*c*.

Figure 4C:
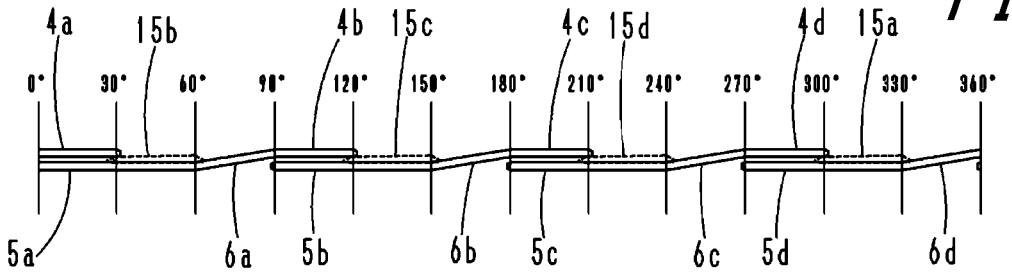

Suppose also that the screw cap B is rotated through 60° or more from the position in which the screw cap B is placed on the container main body A. In this case, as illustrated in FIG. 4C, the lower surfaces of the cap screw protrusions 15*a*, 15*b*, 15*c*, and 15*d* abut against right halves of upper surfaces of the lower long screw protrusions 5*d*, 5*a*, 5*b*, and 5*c* of the slope screw portions 2. Thus, the downward displacement of the screw cap B stops, and the screw cap B is guided further in the circumferential direction.

Even when the length in the circumferential direction of the cap screw protrusions 15*a*, 15*b*, 15*c*, and 15*d* is little greater than the right half of each of the lower long screw protrusions 5*d*, 5*a*, 5*b*, and 5*c*, left end portions of the cap screw protrusions 15*a*, 15*b*, 15*c*, and 15*d* are displaced downward without abutting against right end portions of the upper screw protrusions 4*d*, 4*a*, 4*b*, and 4*c* during the downward displacement in accordance with the obliquity of the oblique screw protrusions 6*d*, 6*a*, 6*b*, and 6*c*. The reason is that the cap screw protrusions 15*a*, 15*b*, 15*c*, and 15*d* each have a width reduced toward the rotational direction. Thus, the rotation and the downward displacement are not interfered with.

When the screw cap B is further rotated, the cap screw protrusions 15*a*, 15*b*, 15*c*, and 15*d* are guided between the upper screw protrusions 4*d*, 4*a*, 4*b*, and 4*c* and left halves of the lower long screw protrusions 5*d*, 5*a*, 5*b*, and 5*c*.

Figure 4D:
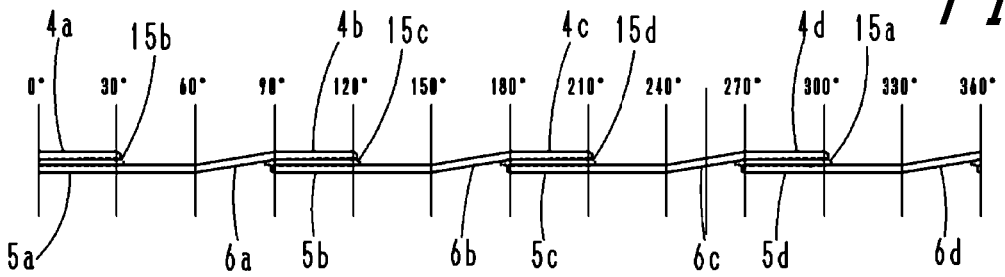
Figure 5A:
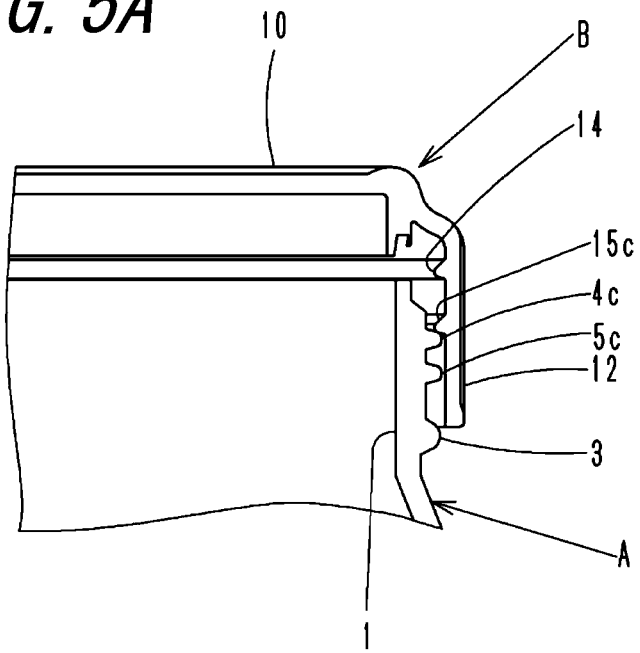
FIGS. 5A and 5B illustrate a container main body and a screw cap at the time of capping according to Embodiments 1 and 2 of the present disclosure, and FIG. 5A corresponds to the time of the beginning of capping, and FIG. 5B corresponds to the time of the end of capping.
Figure 5B:
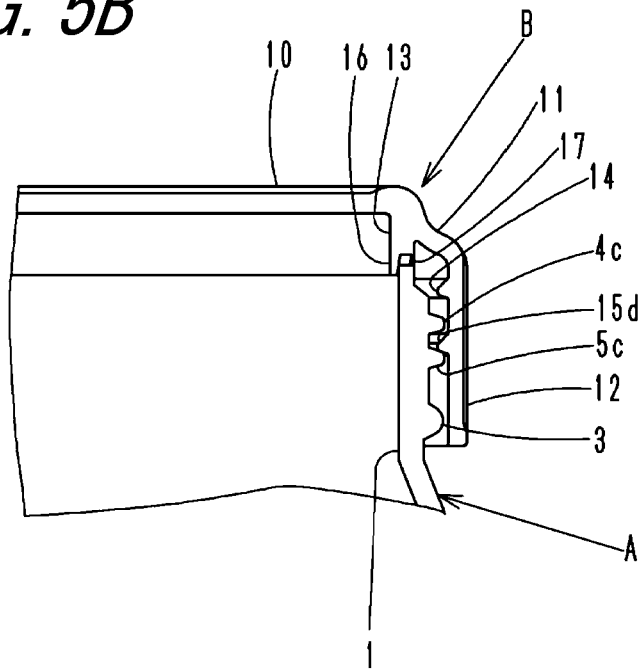

Finally, as illustrated in FIG. 4D, the left end portions of the cap screw protrusions 15*a*, 15*b*, 15*c*, and 15*d* abut against oblique lower surfaces of the oblique screw protrusions 6*c*, 6*d*, 6*a*, and 6*b* of the slope screw portions 2. Consequently, the rotation is stopped, and, as illustrated in FIG. 5B, the screw cap B is closed.

At this time, the inner ring 16, which is provided in the sealing tubular portion 13 of the screw cap B, is inserted in the inner circumference of the mouth tubular portion 1 of the container main body A. Furthermore, the contact ring 17, which is also provided in the sealing tubular portion 13 of the screw cap B, tightly contacts the upper surface of the mouth tubular portion 1. Thus, the inside of the container main body A is surely sealed.

Upon capping, the cap screw protrusions 15*a*, 15*b*, 15*c*, and 15*d* are fitted between the upper screw protrusions 4*d*, 4*a*, 4*b*, and 4*c* and the left halves of the lower long screw protrusions 5*d*, 5*a*, 5*b*, and 5*c*. Accordingly, the screw cap B is prevented from being displaced upward or downward with respect to the container main body A, thus maintaining sealing performance.

Additionally, the screw cap B might be placed on the container main body A, with the cap screw protrusion 15*b* being located at a position corresponding to an angle of greater than 30° and less than 90° in the section a with respected to the container main body A. Even in this case, as illustrated in FIGS. 4B and 4C, the lower surfaces of the cap screw protrusions 15*a*, 15*b*, 15*c*, and 15*d* evenly abut against the oblique screw protrusions 6*a*, 6*b*, 6*c*, and 6*d*, which are disposed at an interval of 90°, or the upper surfaces of the right halves of the lower long screw protrusions 5*a*, 5*b*, 5*c*, and 5*d*. This permits the screw cap B to be always placed horizontally with respect to the mouth tubular portion 1 of the container main body A. Accordingly, the screw cap B is prevented from being placed obliquely with respect to the mouth tubular portion 1, and capping is achieved by rotating the screw cap B correctly with respect to the container main body A.

To open the screw cap B, the screw cap B needs to be rotated anticlockwise through approximately 30°. Then, as illustrated in FIG. 4C, the cap screw protrusions 15*a*, 15*b*, 15*c*, and 15*d* are displaced to positions corresponding to the right halves of the lower long screw protrusions 5*d*, 5*a*, 5*b*, and 5*c* of the slope screw portions 2 in the front view thereof. The cap screw protrusions 15*a*, 15*b*, 15*c*, and 15*d* are released from the state where they are fitted with the upper screw protrusions 4*d*, 4*a*, 4*b*, and 4*c*. As the screw cap B is rotated further (through approximately 5°), the right ends of the lower portions of the cap screw protrusions 15*a*, 15*b*, 15*c*, and 15*d* in the front view abut against the oblique upper surfaces of the oblique screw protrusions 6*d*, 6*a*, 6*b*, and 6*c* of the slope screw portions 2, and the screw cap B is displaced upward. Thus, uncapping is achieved easily.

In the present embodiment, uncapping is achieved easily by unscrewing the screw cap B from the container main body A by rotating the screw cap B through approximately 35° from the capped state.

Figure 6A:
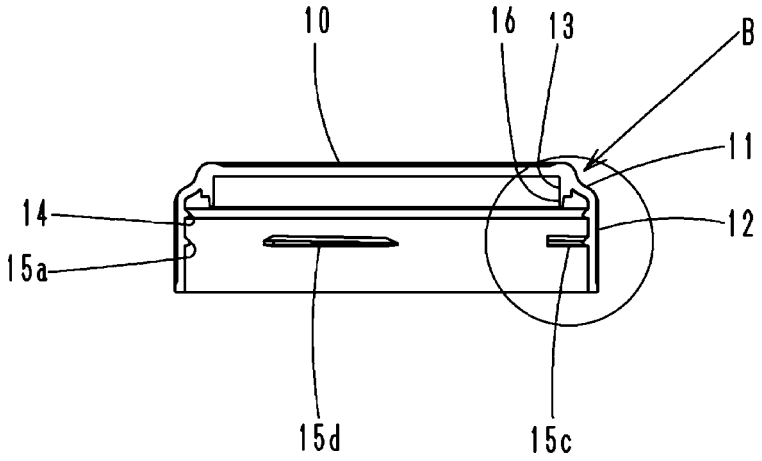
FIGS. 6A and 6B illustrate a screw cap according to a modification of Embodiment 1 of the present disclosure.
Figure 6B:
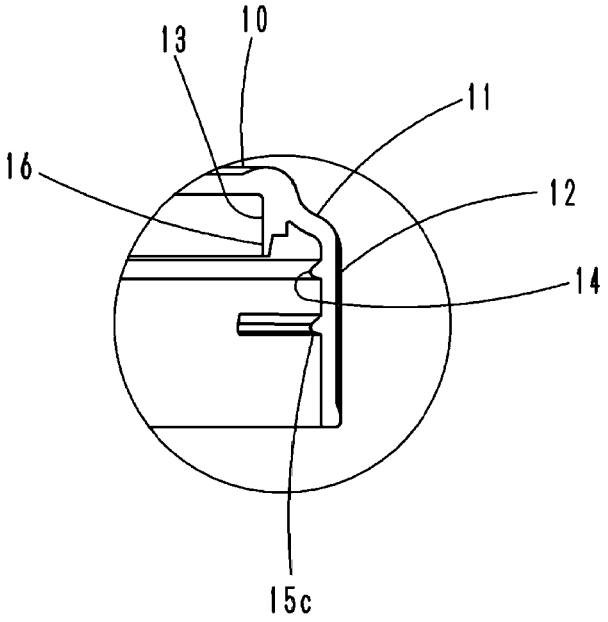

In the present embodiment, the inner ring 16 is suspended on the inner side of the lower end of the sealing tubular portion 13 of the screw cap B, and the contact ring 17, which is formed as the deformable and thin ring, is suspended on the outer side of the lower end of the sealing tubular portion 13 of the screw cap B. However, as illustrated in FIGS. 6A and 6B, in a modification of the sealing tubular portion 13, only the inner ring 16 may be provided in a suspended manner on the inner side of the lower end of the sealing tubular portion 13.

The inside of the container main body A may also be sealed simply by inserting the outer circumference of the inner ring 16 in the inner circumference of the mouth tubular portion 1 of the container main body A.

Embodiment 2

Next, a description is given of Embodiment 2, in which the slope screw portions of Embodiment 1 are modified.

In the following, the same components as those in Embodiment 1 are denoted by the same reference numerals, and the description focuses on differences.

Figure 7A:
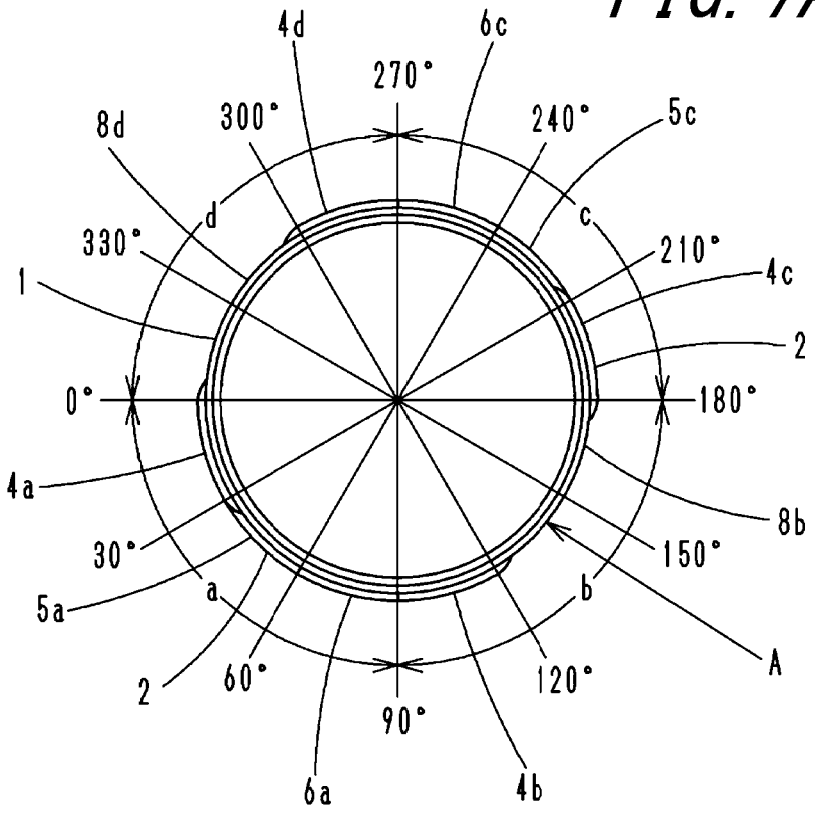
FIGS. 7A and 7B illustrate a container main body according to Embodiment 2 of the present disclosure.
Figure 7B:
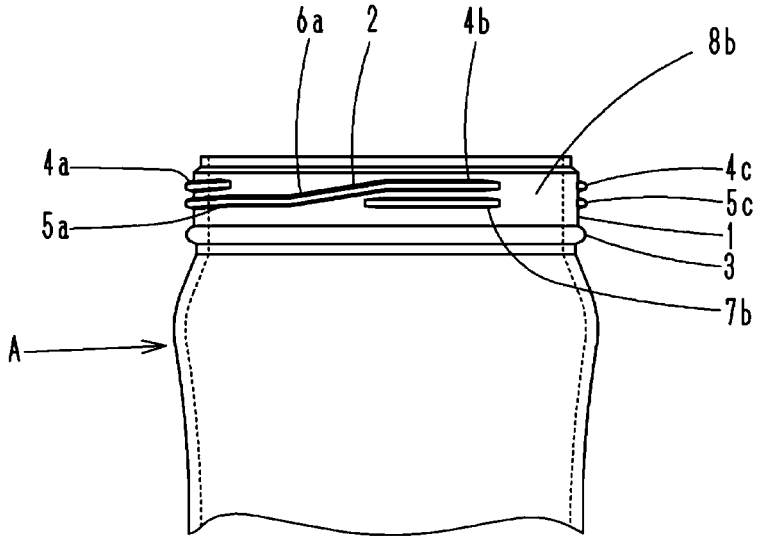

As illustrated in FIGS. 7A and 7B, the container main body A includes the mouth tubular portion 1. The mouth tubular portion 1 is provided on the outer circumference thereof with the slope screw portions 2, which are formed as two ridges configured to be screwed to the screw cap B. The mouth tubular portion 1 is also provided on the outer circumference thereof with the neck ring 3, which protrudes below the slope screw portions 2.

In the top view, the slope screw portions 2 are configured by the upper screw protrusions 4*a*, 4*b*, 4*c*, and 4*d*, the lower long screw protrusions 5*a* and 5*c*, lower short screw protrusions 7*b* and 7*d*, and the oblique screw protrusions 6*a* and 6*c*. In the top view, the upper screw protrusions 4*a*, 4*b*, 4*c*, and 4*d* are disposed at four different positions at an interval of 90°. In the front view, the upper screw protrusions 4*a*, 4*b*, 4*c*, and 4*d* extend horizontally or gently obliquely in the lower left direction and, as illustrated in FIGS. 8A to 8D, each have a length in the circumferential direction of approximately 30°. The lower long screw protrusions 5*a* and 5*c* are disposed a predetermined interval (height) (which is set as the width of the cap screw protrusions 15*a* to 15*d*, which are described later) below and in parallel with the upper screw protrusions 4*a* and 4*c*, have left end positions same as left end positions of the upper screw protrusions 4*a* and 4*c*, and each have a length in the circumferential direction of approximately 60° (which is longer than the length in the circumferential direction of the upper screw protrusions 4*a* and 4*c*). The lower short screw protrusions 7*b* and 7*d* are disposed at a predetermined interval (height) below and in parallel with the upper screw protrusions 4*b* and 4*d*, have left end positions same as left end positions of the upper screw protrusions 4*b* and 4*d*, and each have a length in the circumferential direction of approximately 30° (which is equal to the length in the circumferential direction of the upper screw protrusions 4*a*, 4*b*, 4*c*, and 4*d*). The oblique screw protrusions 6*a* and 6*c* extend obliquely in the upper right direction from right ends of the lower long screw protrusions 5*a* and 5*c* and each are connected to the left end of a different one of the upper screw protrusion 4*a* and 4*d*.

Furthermore, in the outer circumference of the mouth tubular portion 1, a gap 8*b* is defined between the upper screw protrusion 4*b*, along with the lower short screw protrusion 7*b*, and the upper screw protrusion 4*c*, along with the lower long screw protrusion 5*c*, and a gap 8*d* is defined between the upper screw protrusion 4*d*, along with the lower short screw protrusion 7*d*, and the upper screw protrusion 4*a*, along with the lower long screw protrusion 5*a*. The gaps 8*b* and 8*d* each have a length in the circumferential direction of approximately 60°, and no screw protrusions are present there.

In the present embodiment, the upper screw protrusions 4*a* etc. of the slope screw portions 2 are disposed at the four positions at an equal interval. However, the upper screw protrusions 4*a* etc. only need to be disposed at four or more even number of positions at an equal interval. The gaps 8*b* and 8*d* only need to be defined at two positions at an interval of 180° in the top view.

Next, a description is given of modes of use and advantageous effects of the present embodiment.

Figure 8A:
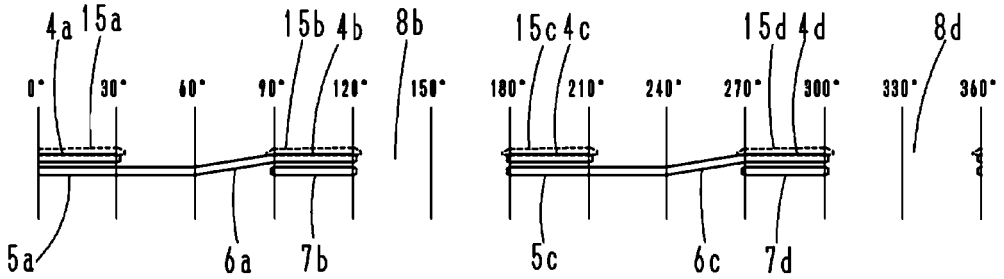
FIGS. 8A to 8D are interaction views of slope screw portions of a container main body and cap screw protrusions of a screw cap according to Embodiment 2 of the present disclosure, and FIG. 8A corresponds to time of the beginning of capping, FIG. 8B corresponds to the initial time of rotation, FIG. 8C corresponds to the middle time of rotation, and FIG. 8D corresponds to the time of the end of capping.

Similarly to Embodiment 1, suppose that the screw cap B is placed from above on the mouth tubular portion 1 of the container main body A, with the lower surfaces of the cap screw protrusions 15*a*, 15*b*, 15*c*, and 15*d* abutting against the upper surfaces of the upper screw protrusions 4*a*, 4*b*, 4*c*, and 4*d* of the container main body A as illustrated in FIG. 8A.

Figure 8B:
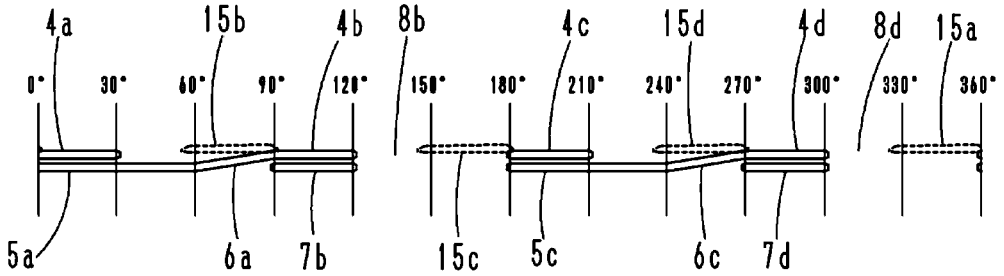

Subsequently, suppose that the screw cap B is rotated through 30° or more from the position in which the screw cap B is placed on the container main body A. Then, the cap screw protrusions 15*a*, 15*b*, 15*c*, and 15*d* are displaced off from the upper surfaces of the upper screw protrusions 4*a*, 4*b*, 4*c*, and 4*d*. As illustrated in FIG. 8B, the right ends of the lower surfaces of the cap screw protrusions 15*b* and 15*d* abut against the oblique upper surfaces of the oblique screw protrusions 6*a* and 6*c*. As the rotation further proceeds, the screw cap B is displaced downward in accordance with obliquity of the oblique screw protrusions 6*a* and 6*c*.

At this time, the cap screw protrusions 15*a* and 15*c* are located in the gaps 8*d* and 8*b*. Accordingly, the screw cap B is rotated and displaced downward without any resistance.

Figure 8C:
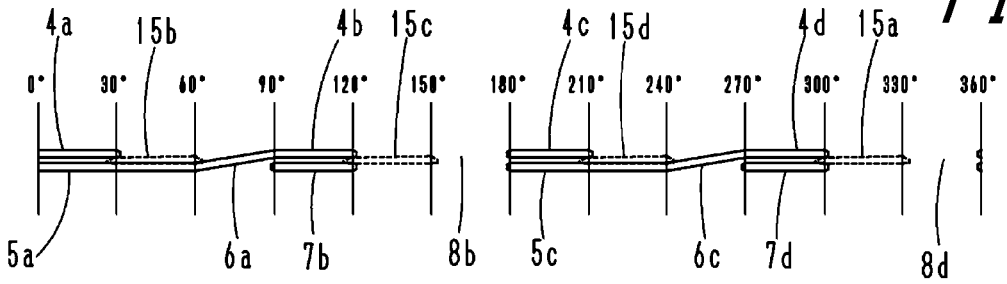

Suppose also that the screw cap B is rotated through 60° or more from the position in which the screw cap B is placed on the container main body A. In this case, as illustrated in FIG. 8C, the lower surfaces of the cap screw protrusions 15*b* and 15*d* abut against the right halves of the upper surfaces of the lower long screw protrusions 5*a* and 5*c*. Thus, the downward displacement of the screw cap B stops, and the screw cap B is guided further in the circumferential direction.

At this time, the cap screw protrusions 15*a* and 15*c* are still located in the gaps 8*d* and 8*b* and accordingly, guided in the circumferential direction without any resistance.

When the screw cap B is further rotated, the cap screw protrusion 15*b* is guided between the upper screw protrusion 4*a* and the left half of the lower long screw protrusion 5*a*, and the cap screw protrusion 15*d* is guided between the upper screw protrusion 4*c* and the left half of the lower long screw protrusion 5*c*. Furthermore, the cap screw protrusion 15*a* is guided between the upper screw protrusion 4*d* and the lower short screw protrusion 7*d*, and the cap screw protrusion 15*c* is guided between the upper screw protrusion 4*b* and the lower short screw protrusion 7*b*.

Figure 8D:
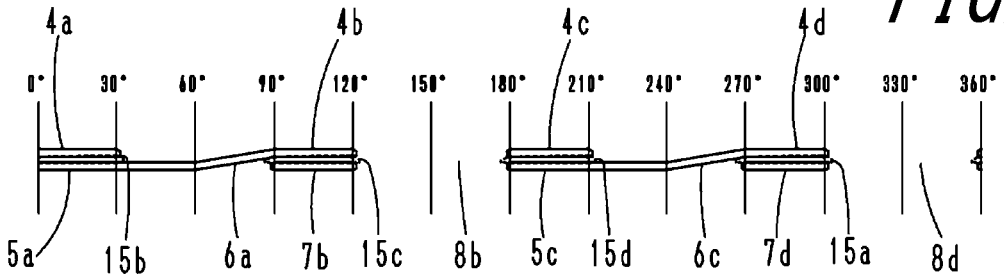

Finally, as illustrated in FIG. 8D, the left end portions of the cap screw protrusions 15*a* and 15*c* abut against the oblique lower surfaces of the oblique screw protrusions 6*c* and 6*a*. Consequently, the rotation is stopped, and, as illustrated in FIG. 5B, the screw cap B is closed.

In the present embodiment, the gaps 8*b* and 8*d* are present on a parting line, where no screw protrusions are present. This permits smooth mold opening and closing at the time of molding and also prevents, even when a burr is generated on the parting line, the problem of hooking at the time of opening and closing the cap.

Furthermore, the presence of the gaps 8*b* and 8*d* helps reduce the amount of resin used in molding.

Additionally, when the above problem is unlikely to occur, the slope screw portions may be formed contiguously from the lower short screw protrusions 7*b* and 7*d*.

Other advantageous effects are substantially the same as those in Embodiment 1 and the modification thereof.

Embodiment 3

Next, a description is given of Embodiment 3, in which the shape of the screw cap in Embodiment 1 is modified.

In the following, the same components as those in Embodiment 1 are denoted by the same reference numerals, and the description focuses on differences.

Figure 9A:
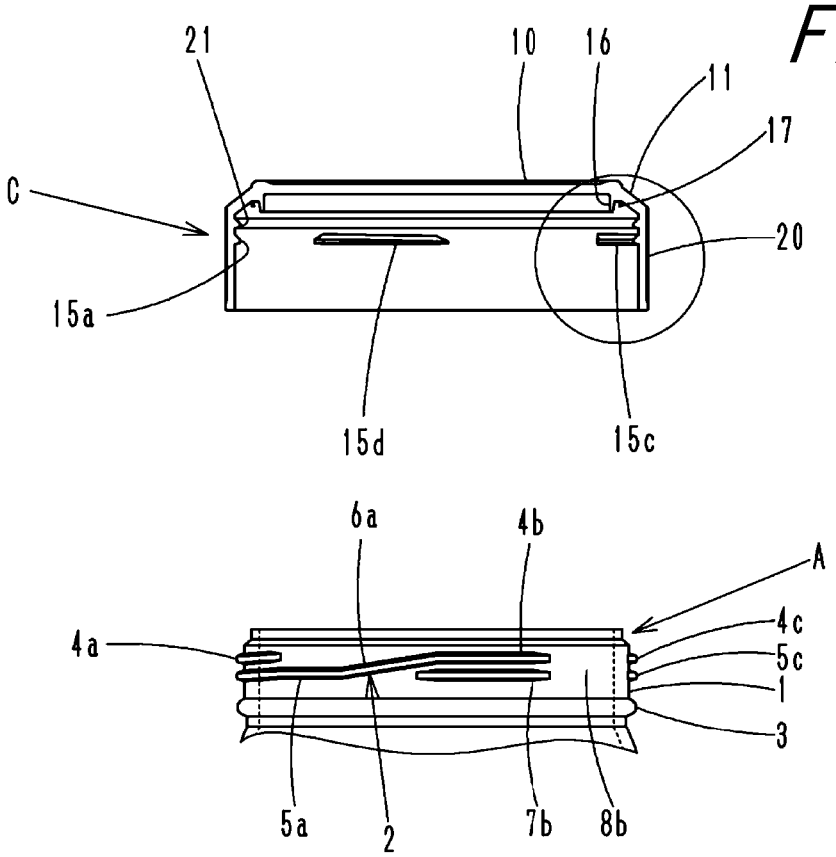
FIGS. 9A and 9B illustrate a screw cap and a container main body according Embodiment 3 of the present disclosure.
Figure 9B:
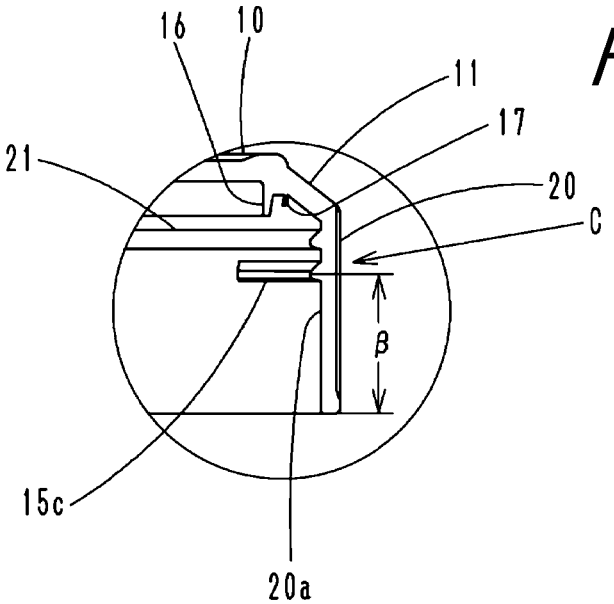

As illustrated in FIGS. 9A and 9B, a screw cap C includes the disc-shaped top wall 10, the inclined wall 11, which is connected to the outer edge of the top wall 10 and which is inclined outward and downward, and an outer circumferential wall 20, which is suspended from the outer edge of the inclined wall 11.

The top wall 10 is provided, in an outer edge end portion of the back surface thereof, with the contact ring 17 in a suspended manner. The contact ring 17 is formed as a deformable and thin ring having the tip portion configured to tightly contact the upper surface of the mouth tubular portion 1 of the container main body A at the time of capping. The top wall 10 is also provided, in a predetermined position on the back surface that is located on the inner side of the contact ring 17, with the inner ring 16 in a suspended manner. The inner ring 16 is configured to be inserted in the inner circumference of the mouth tubular portion 1 of the container main body A and has the outer circumference that seals the inside of the container main body A at the time of capping.

The outer circumferential wall 20 is provided, in an upper end portion of an inner circumference thereof, with an annular protrusion 21. The outer circumferential wall 20 is also provided, in portions thereof that are located below the annular protrusion 21, with the cap screw protrusions 15*a*, 15*b*, 15*c*, and 15*d*. The cap screw protrusions 15*a*, 15*b*, 15*c*, and 15*d* are disposed at an interval of 90° at four different positions that are located above the middle of the outer circumferential wall 20, that is to say, at a height β from a lower end of the outer circumferential wall 20.

Additionally, a portion of the inner circumference of the outer circumferential wall 20 that is located below the cap screw protrusions 15*a*, 15*b*, 15*c*, and 15*d* forms an engagement surface 20*a*, which has the height β from the lower end of the outer circumferential wall 20.

Next, a description is given of modes of use and advantageous effects of the present embodiment.

When the screw cap B is placed from above on the mouth tubular portion 1 of the container main body A, the screw cap C is displaced downward, with the engagement surface 20*a* on the inner circumference of the outer circumferential wall 20 being in sliding contact with the outer circumferences of the slope screw portions 2 of the container main body A.

Figure 10A:
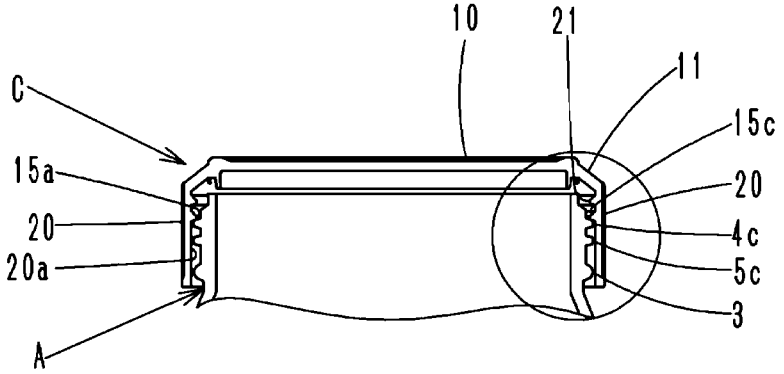
FIGS. 10A and 10B illustrate a container main body and a screw cap at time of the beginning of capping according Embodiment 3 of the present disclosure.
Figure 10B:
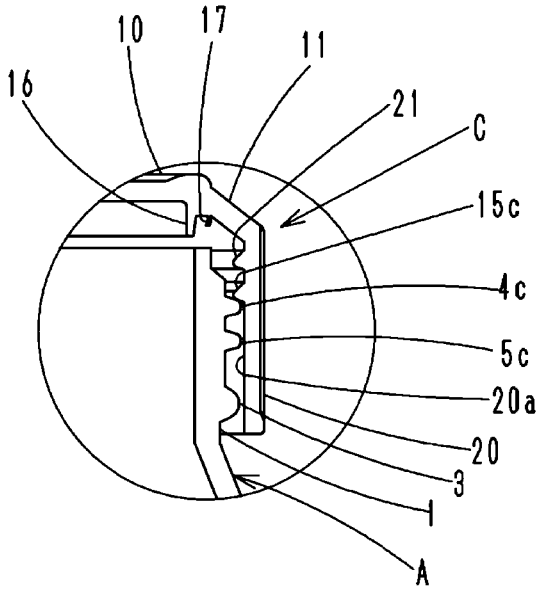
Figure 11A:
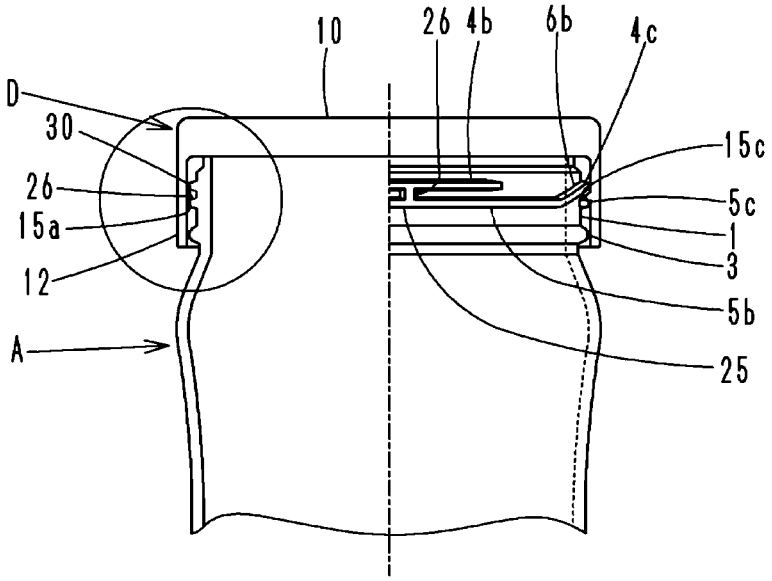
FIGS. 11A and 11B illustrate a screw cap and a container main body according Embodiment 4 of the present disclosure.
Figure 11B:
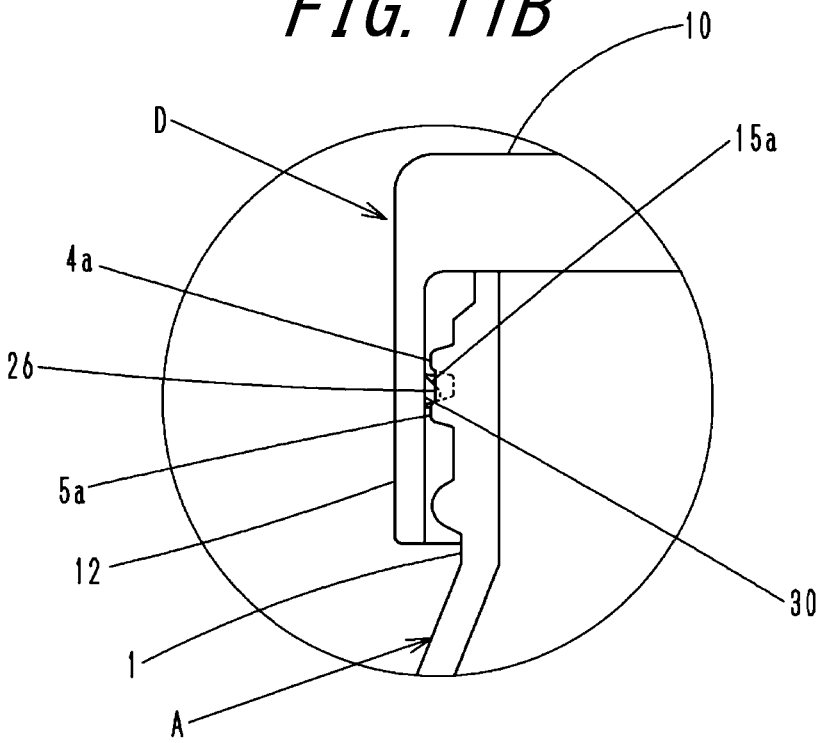
Figure 12A:
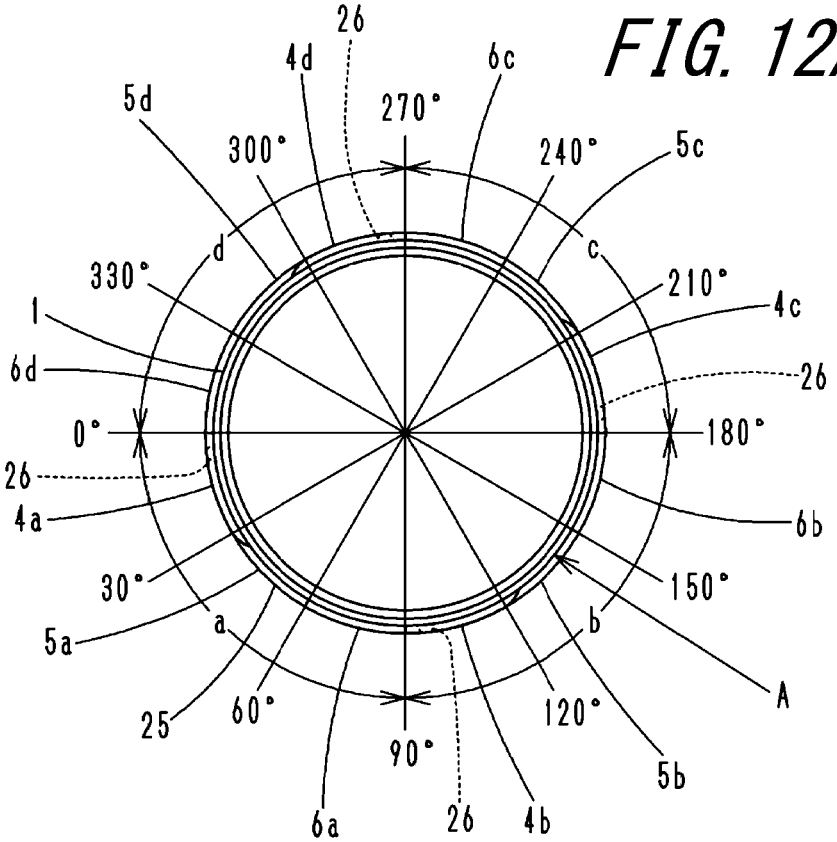
FIGS. 12A and 12B illustrate a container main body according to Embodiment 4 of the present disclosure.
Figure 12B:
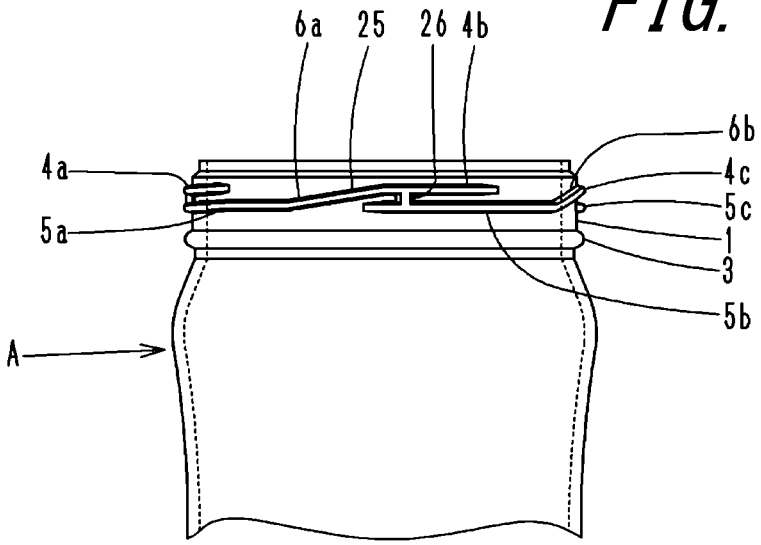
Figure 13A:
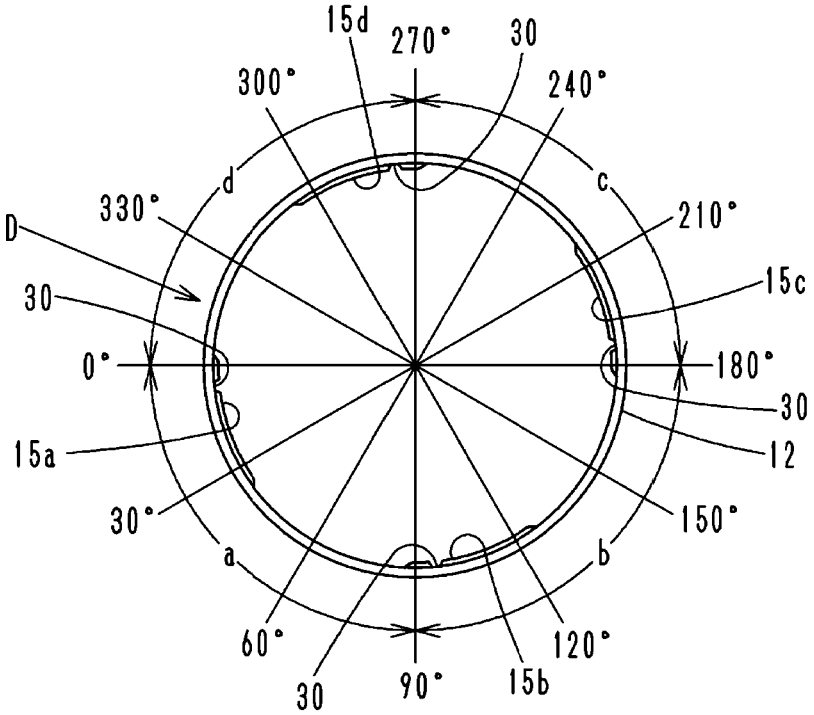
FIGS. 13A and 13B illustrate a screw cap according to Embodiment 4 of the present disclosure.
Figure 13B:
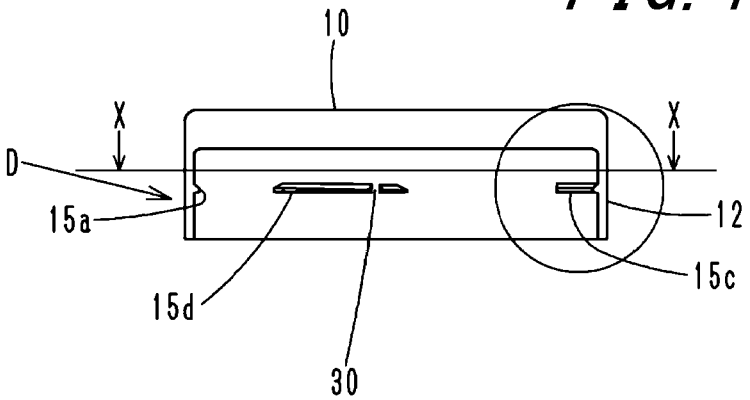

As illustrated in FIGS. 10A and 10B, the cap screw protrusions 15*a* etc. of the present embodiment are formed at the height β from the lower end of the inner circumference of the outer circumferential wall 20. Compared with the engagement surface 12*a*, which is formed at the height α from the lower end of the inner circumference of the outer circumferential wall 12 of the screw cap B in Embodiment 1, the engagement surface 20*a* is longer. Accordingly, when being placed on the container main body A, the screw cap C may be placed more deeply over the container main body A compared with the screw cap B of Embodiment 1. This means that the screw cap C abuts against a greater extent of the outer circumferences of the slope screw portions 2 of the container main body A and also abuts against an outer circumference of the neck ring 3. Thus, the screw cap C is prevented from being placed obliquely with respect to the mouth tubular portion 1.

Furthermore, in the present embodiment, the screw cap C does not include the sealing tubular portion. Since the screw cap C includes the inner ring 16 and the contact ring 17, which are suspended directly from the back surface of the top wall 10, the amount of resin used in molding is reduced.

Other advantageous effects are substantially the same as those in Embodiment 1 and the modification thereof.

Embodiment 4

Next, a description is given of Embodiment 4, in which the slope screw portions of the container main body and the cap screw protrusions of the screw cap in Embodiment 1 are modified.

In the following, the same components as those in Embodiment 1 are denoted by the same reference numerals, and the description focuses on differences.

As illustrated in FIGS. 11A, 11B, 12A, and 12B, the container main body A includes the mouth tubular portion 1. The mouth tubular portion 1 is provided on the outer circumference thereof with slope screw portions 25, which are formed as four ridges configured to be screwed to a screw cap D. The mouth tubular portion 1 is also provided on the outer circumference thereof with the neck ring 3, which protrudes below the slope screw portions 25.

The slope screw portions 25 are configured by the upper screw protrusions 4*a*, 4*b*, 4*c*, and 4*d*, the lower long screw protrusions 5*a*, 5*b*, 5*c*, and 5*d*, the oblique screw protrusions 6*a*, 6*b*, 6*c*, and 6*d*, and engagement protrusions 26. In the top view, the upper screw protrusions 4*a*, 4*b*, 4*c*, and 4*d* are disposed at four different positions at an (equal) interval of 90°. The engagement protrusions 26 are disposed between the left sides of the middles of the upper screw protrusions 4*a*, 4*b*, 4*c*, and 4*d* and the lower long screw protrusions 5*a*, 5*b*, 5*c*, and 5*d* in the front view thereof.

As illustrated in FIGS. 11A, 11B, 13A, and 13B, the screw cap D includes the outer circumferential wall 12. The outer circumferential wall 12 is provided on the inner circumference thereof with the cap screw protrusions 15*a*, 15*b*, 15*c*, and 15*d*, which are disposed at four different positions at an (equal) interval of 90° in the circumferential direction. The cap screw protrusions 15*a*, 15*b*, 15*c*, and 15*d* are also provided, on the outer sides thereof, that is, on the left sides in the front view thereof, with engagement recesses 30, which are configured to be fitted with the engagement protrusions 26 of the slope screw portions 25 at the time of capping.

Next, a description is given of modes of use and advantageous effects of the present embodiment.

Similarly to Embodiment 1, for capping, the screw cap D is placed from above on the mouth tubular portion 1 of the container main body A, displaced downward, and rotated.

In the present embodiment, at the time just before the end of capping with the screw cap D, as illustrated in FIGS. 14A and 14B, left ends of the cap screw protrusions 15*a*, 15*b*, 15*c*, and 15*d* of the screw cap D abut against and climb on the engagement protrusions 26 of the slope screw portions 25 of the container main body A. Consequently, portions of the outer circumferential wall 12 of the screw cap D are expanded to the outer side and deformed.

At the time of the end of rotation, as illustrated in FIGS. 14C and 14D, the engagement protrusions 26 enter the engagement recesses 30, which are provided in the cap screw protrusions 15*a*, 15*b*, 15*c*, and 15*d* of the screw cap D, to be fitted thereto.

With the engagement protrusions 26 entering the engagement recesses 30, the climbing of the cap screw protrusions 15*a*, 15*b*, 15*c*, and 15*d* is resolved, and the force expanding the outer circumferential wall 12 to the outer side is cancelled. Accordingly, the outer circumferential wall 12 is returned to the original state.

The outer circumferential wall 12, which is expanded at the time just before the end of capping and which returns to the original state at the time of the end of rotation, provides a click sensation to a user.

To open the screw cap D, the screw cap D needs to be rotated in an uncapping direction. Then, the engagement recesses 30 of the cap screw protrusions 15*a*, 15*b*, 15*c*, and 15*d* of the screw cap D are released from the state where they are fitted with the engagement protrusions 26 of the container main body A. The cap screw protrusions 15*a*, 15*b*,

15*c*, and 15*d* abut against and climb on the engagement protrusions 26. Consequently, the outer circumferential wall 12 of the screw cap D is expanded to the outer side and deformed. As the screw cap D is rotated further, the engagement recesses 30 of the cap screw protrusions 15*a*, 15*b*, 15*c*, and 15*d* are released from the state where they abut against the engagement protrusions 26 of the container main body A, and the outer circumferential wall 12 is returned to the original state. Thus, a click sensation is provided to a user.

The container of the present embodiment provides a click sensation to a user at the time of the end of capping and the beginning of uncapping. Furthermore, since the engagement protrusions 26 of the slope screw portions 25 of the container main body A are fitted into the engagement recesses 30 of the cap screw protrusions 15*a*, 15*b*, 15*c*, and 15*d* of the screw cap D at the time of capping, this provides resistance that prevents the screw cap D from being rotated spontaneously and opened due to an external impact outside the container.

Other advantageous effects are substantially the same as those in Embodiment 1 and the modification thereof.

Needless to say, the configurations of the cap screw protrusions of the screw cap and the engagement protrusions of the slope screw portions of the container main body according to the present embodiment may be applied to the configurations of Embodiments 2 and 3.

In the present embodiment, the engagement protrusions 26 of the slope screw portions 25 are disposed in total at the four positions between the upper screw protrusions 4*a*, 4*b*, 4*c*, and 4*d* and the lower long screw protrusions 5*a*, 5*b*, 5*c*, and 5*d*. However, the engagement protrusion(s) 26 may also be disposed at one or more of the four positions.

Embodiment 5

Next, a description is given of Embodiment 5, in which the neck ring of the container main body and the outer circumferential wall of the screw cap in Embodiment 1 are modified.

In the following, the same components as those in Embodiment 1 are denoted by the same reference numerals, and the description focuses on differences.

Figure 15:
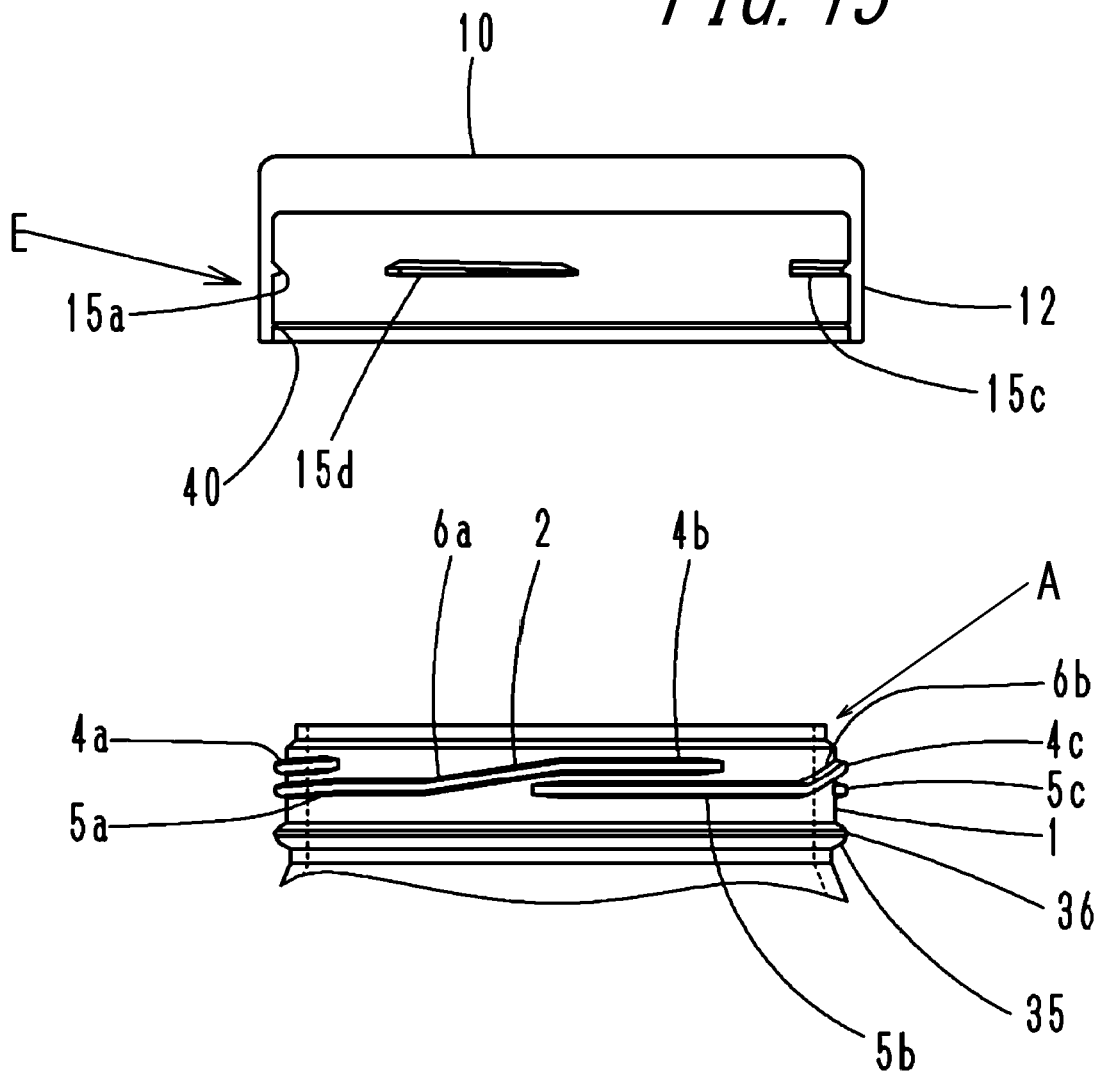
FIG. 15 is a partially perspective side view of a screw cap and a container main body according Embodiment 5 of the present disclosure.

As illustrated in FIGS. 15A and 15B, the container main body A includes the mouth tubular portion 1. The mouth tubular portion 1 is provided on the outer circumference thereof with the slope screw portions 2, which protrude as two ridges configured to be screwed to a screw cap E. The mouth tubular portion 1 is also provided on the outer circumference thereof with a neck ring 35, which protrudes below the slope screw portions 2.

The neck ring 35 is provided around an outer circumference thereof with an outward engagement ridge 36.

The screw cap E includes the outer circumferential wall 12. The outer circumferential wall 12 is provided, in a lower portion of the inner circumference thereof, with an inward engagement ridge 40, which has an upper portion configured to abut against a lower portion of the outward engagement ridge 36 of the neck ring 35 of the container main body A at the time of capping.

Next, a description is given of modes of use and advantageous effects of the present embodiment.

Similarly to Embodiment 1, for capping, the screw cap E is placed from above on the mouth tubular portion 1 of the container main body A, displaced downward, and rotated.

In the present embodiment, when the screw cap E is displaced downward until the time just before the end of capping, a lower surface of the inner engagement ridge 40 of the screw cap E abuts against and climbs on an upper surface of the outward engagement ridge 36 of the neck ring 35 of the container main body A. Consequently, a portion of the outer circumferential wall 12 of the screw cap E is expanded to the outer side and deformed.

Figure 16A:
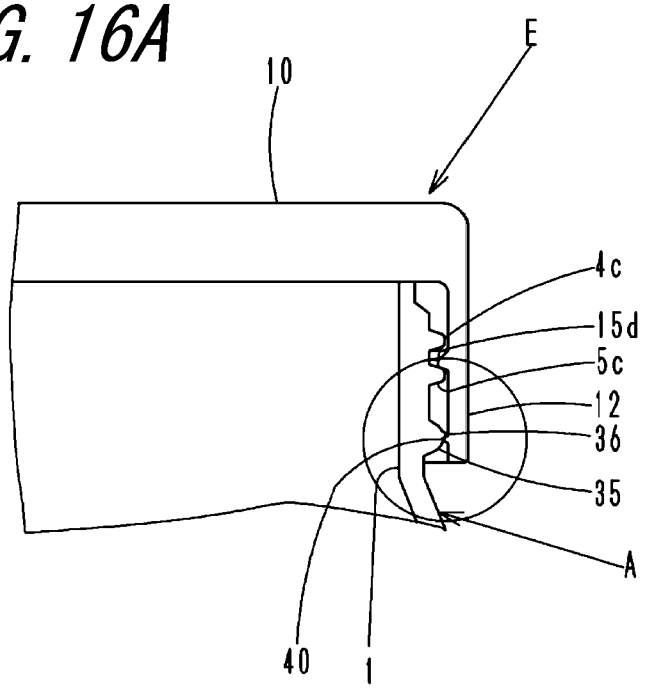
FIGS. 16A and 16B illustrate Embodiment 5 of the present disclosure at the time of capping.
Figure 16B:
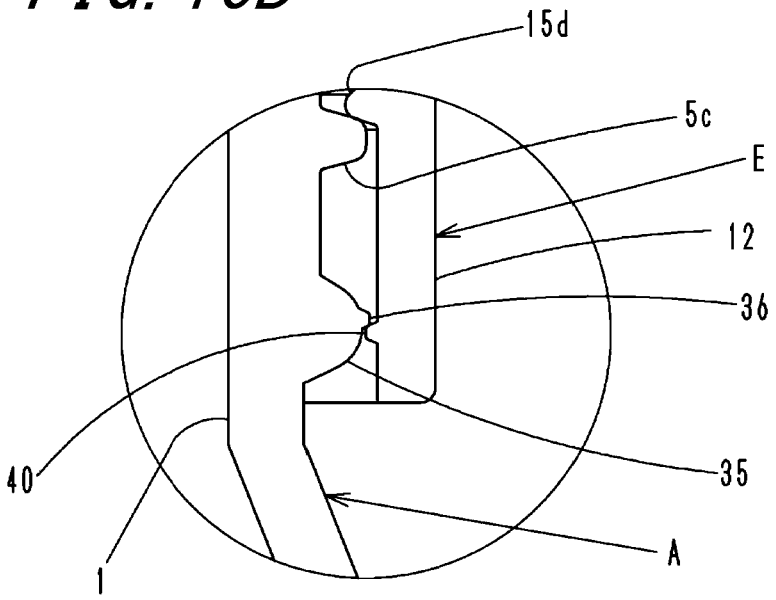

Then, at the time of the end of capping, as illustrated in FIGS. 16A and 16B, the inward engagement ridge 40 of the screw cap E climbs over the outward engagement ridge 36 of the container main body A. Consequently, the outer circumferential wall 12 of the screw cap E is returned to the original state, with an upper surface of the inward engagement ridge 40 abutting against a lower surface of the outward engagement ridge 36. Thus, capping is achieved.

The outer circumferential wall 12, which is expanded at the time just before the end of capping and which returns to the original state due to the inward engagement ridge 40 climbing over the outward engagement ridge 36 at the time of the end of capping, provides a click sensation to a user.

To open the screw cap E, the screw cap E needs to be rotated in an uncapping direction. Then, the screw cap E is displaced upward, and the inward engagement ridge 40 climbs over the outward engagement ridge 36 of the container main body A. Consequently, the outer circumferential wall 12 is expanded and subsequently returned to the original state. Thus, a click sensation is provided to a user.

The container of the present embodiment provides a click sensation to a user at the time of the end of capping and the beginning of uncapping. Furthermore, since the upper surface of the inward engagement ridge 40 of the screw cap E abuts against the lower surface of the outward engagement ridge 36 of the container main body A at the time of capping, this provides resistance that prevents the screw cap E from being rotated spontaneously and opened due to an external impact outside the container.

Other advantageous effects are substantially the same as those in Embodiment 1 and the modification thereof.

Needless to say, the configurations of the engagement ridges of the screw cap and the container main body according to the present embodiment may be applied to the configurations of Embodiments 2 and 3.

Additionally, although in the above embodiments the screw cap is rotated clockwise for capping, the screw cap may also be configured to be rotated reversely, namely, anticlockwise for capping. In this case also, the same advantageous effects are obtained. That is to say, even when the slope screw portions of the container main body and the cap screw protrusions of the screw cap are reversed right-side left, the same advantageous effects as in the above embodiments are obtained.

INDUSTRIAL APPLICABILITY

The screw cap container according to the present disclosure prevents the cap from being placed obliquely with respect to the container main body at the time of capping, permits easy sealing of the container, is configured to be uncapped by unscrewing the cap easily with a little rotational angle at the time of uncapping, and provides a click sensation to a user at the time of uncapping and capping, and as such, may be widely used.

REFERENCE SIGNS LIST

A Container main body
B, C, D, E Screw cap
a, b, c, d Section
α, β Height

γ Width
δ Length in circumferential direction of upper screw protrusion
ε Length in circumferential direction of oblique screw protrusion
ζ Length in circumferential direction of lower long screw protrusion
1 Mouth tubular portion
2, 25 Slope screw portion
3, 35 Neck ring
4*a*, 4*b*, 4*c*, 4*d* Upper screw protrusion
5*a*, 5*b*, 5*c*, 5*d* Lower long screw protrusion
6*a*, 6*b*, 6*c*, 6*d* Oblique screw protrusion
7*b*, 7*d* Lower short screw protrusion
8*b*, 8*d* Gap
10 Top wall
11 Inclined wall
12, 20 Outer circumferential wall
12*a*, 20*a* Engagement surface
13 Sealing tubular portion
14, 21 Annular protrusion
15*a*, 15*b*, 15*c*, 15*d* Cap screw protrusion
16 Inner ring
17 Contact ring
26 Engagement protrusion
30 Engagement recess
36 Outward engagement ridge
40 Inward engagement ridge

The invention claimed is:

1. A screw cap container comprising a container main body and a screw cap, wherein the container main body includes a mouth tubular portion, which is provided on an outer circumference thereof with slope screw portions configured to be screwed to the screw cap, the slope screw portions include: upper screw protrusions disposed at three or more different positions at an equal interval in a top view thereof; lower long screw protrusions having left end positions same as left end positions of the upper screw protrusions, being disposed a predetermined height below and in parallel with the upper screw protrusions, and each having a length longer than a length of each upper screw protrusion; and oblique screw protrusions extending obliquely relative to the lower long screw protrusions in an upper right direction from right ends of the lower long screw protrusions and each being connected to a left end of a different one of the upper screw protrusions, the screw cap includes a top wall and an outer circumferential wall suspended from an outer edge of the top wall, and the outer circumferential wall is provided on an inner circumference thereof with cap screw protrusions disposed at an equal interval and at an equal height in the same number as the number of the upper screw protrusions and thus configured to be screwed with the slope screw portions of the container main body.

2. The screw cap container according to claim 1, wherein the slope screw portions include: the upper screw protrusions disposed at four or more even number of positions; and partial gaps in which no oblique screw protrusions and no lower long screw protrusions are present, the gaps being defined between one of the upper screw protrusions and another one of the upper screw protrusions located adjacent thereto at two different positions at an interval of 180° in the top view thereof.

3. The screw cap container according to claim 1, wherein the cap screw protrusions are disposed at positions above a middle of a vertical height of the inner circumference of the outer circumferential wall, thereby permitting the screw cap to be placed deeply.

4. The screw cap container according to claim 1, wherein the screw cap includes a sealing tubular portion suspended from a back surface of the top wall, and the sealing tubular portion is provided on an inner side of a lower end thereof with an inner ring in a suspended manner, the inner ring being configured to be inserted in an inner circumference of the mouth tubular portion of the container main body and seal an inside of the container main body at the time of capping.

5. The screw cap container according to claim 4, wherein the sealing tubular portion is further provided on an outer side of the lower end thereof with a contact ring in a suspended manner, the contact ring being deformable and having a tip portion configured to tightly contact an upper surface of the mouth tubular portion of the container main body at the time of capping.

6. The screw cap container according to claim 1, wherein the slope screw portions further include engagement protrusions disposed between the upper screw protrusions and the lower long screw protrusions, and the cap screw protrusions of the screw cap are provided with engagement recesses.

7. The screw cap container according to claim 1, wherein the mouth tubular portion of the container main body is further provided on the outer circumference thereof with a neck ring, the neck ring is provided on an outer circumference thereof with an outward engagement ridge, and the outer circumferential wall of the screw cap is further provided on the inner circumference thereof with an inward engagement ridge.

* * * * *